United States Patent [19]

Lewis

[11] Patent Number: 4,538,728

[45] Date of Patent: Sep. 3, 1985

[54] GOLF BAG SECURITY DEVICE

[76] Inventor: Elmer R. Lewis, 1878 E. Calaveras St., Altadena, Calif. 91001

[21] Appl. No.: 663,356

[22] Filed: Oct. 22, 1984

[51] Int. Cl.[3] ..... A63B 55/00

[52] U.S. Cl. ..... 206/315.3

[58] Field of Search ..... 206/315.2–315.8; 150/52 R, 52 G; 224/274; 383/71; 24/30.5 R; 220/210; 190/101; 273/32 E

[56] References Cited

U.S. PATENT DOCUMENTS

| | | | |
|---|---|---|---|
| 779,614 | 1/1905 | Loe | 24/30.5 R |
| 1,570,510 | 1/1926 | McQuirk | 206/315.4 |
| 1,599,170 | 9/1926 | Fatjo | 206/315.6 |
| 1,717,959 | 6/1929 | Cauffman | 206/315.6 |
| 1,731,588 | 10/1929 | Patterson | 206/315.6 |
| 1,770,060 | 7/1930 | Barlow | 206/315.6 |
| 1,788,478 | 1/1931 | Beaty et al. | 206/315.6 |
| 1,908,998 | 5/1933 | Mullins | 206/315.4 |
| 1,928,922 | 10/1933 | Adams | 206/315.4 |
| 2,114,870 | 4/1938 | Calkins | 206/315.6 |
| 2,551,780 | 5/1951 | Wood | 206/315.6 X |
| 3,909,031 | 9/1975 | Schmaedeke et al. | 150/52 R X |
| 4,042,918 | 8/1977 | Klitzman | 206/315.6 X |
| 4,254,888 | 3/1981 | Chandler | 220/210 |
| 4,275,485 | 6/1981 | Hutchison | 383/71 X |

FOREIGN PATENT DOCUMENTS

| | | | |
|---|---|---|---|
| 221272 | 3/1909 | Fed. Rep. of Germany | 383/22 |
| 11930 | of 1892 | United Kingdom | 24/30.5 R |
| 5850 | of 1904 | United Kingdom | 24/30.5 R |
| 28528 | of 1905 | United Kingdom | 206/315.3 |
| 27842 | of 1912 | United Kingdom | 383/71 |

*Primary Examiner*—William Price
*Assistant Examiner*—Sue A. Weaver

[57] ABSTRACT

The security device is adapted for combination with the upper portion of a golf club bag, and includes two semi-circular shells which are hinged to close about the mouth of the golf bag. An opening in the center of the device includes a resilient retaining member designed to clamp a set of golf clubs within the device when closed about the mouth of the golf bag. A chain ring is also mounted to the mouth of the golf bag and permits the bag to be chained to a support or stand.

5 Claims, 3 Drawing Figures

GOLF BAG SECURITY DEVICE

BACKGROUND OF THE INVENTION

1. Field of the Invention

This invention is directed to a security device for combination with a golf club bag, for the purpose of locking golf clubs within the golf club bag to prevent theft of the golf clubs. More particularly, the security device of the invention comprises two semi-circular half shells, designed to fit over the top of a golf bag, which can be locked together and onto the golf bag, safely retaining a set of golf clubs within the security device.

2. Prior Art

Theft of golf clubs from unattended golf bags at public golf courses or country clubs has unfortunately been a not uncommon occurence through the years. Various devices have been designed to prevent the unauthorized removal of golf clubs from a golf bag under such circumstances, with varying degrees of success and convenience. Various covers designed to fit over the mouth of a golf bag and completely envelop the golf clubs within, with the cover locking in some manner to prevent unauthorized access, are known from U.S. Pat. Nos. 1,570,510 (McQuirk); 1,928,922 (Adams); and 1,908,998 (Mullins). Such devices are generally cloth or leather, and can be easily cut open to allow ready removal of golf clubs, and do not hold the golf clubs themselves securely in place, so that once the cover is breached, selection and removal of a golf club is an easy matter. Covers for golf bags having a plurality of holes through which individual golf club shafts may extend are known from U.S. Pat. Nos. 1,770,060 (Barlow) and 1,717,959 (Cauffman). However, the golf bag cover known from U.S. Pat. No. 1,770,060 only secures the golf clubs against removal from the golf bag when the golf club heads are placed down within the golf club bag, with the handles of the shafts extending through the locked cover. Use of this security device requires the inconvenience of turning all of the golf clubs over each time the clubs are secured or unsecured in the bag. The golf bag cover of U.S. Pat. No. 1,717,959 involves an ingenious rotating disc which may be merely rotated to securely clamp or unclamp the golf club shaft within the cover. However, the discs of the cover which clamp the golf club shafts in place are metal and contain uniformly sized holes, which may cause the finish of the shafts of some of the clubs to be marred or cut, as the shafts may be of slightly different lengths and slightly different widths at the level at which the shafts are contacted by the discs. Furthermore, since the shafts are not completely uniformed in width, some of the clubs may be tightly clamped within the cover while other clubs may rattle loosely within the holes provided.

SUMMARY OF THE INVENTION

This invention is directed to a device for securing and locking golf clubs within a golf bag, and for securing and locking the golf bag to a support or stand, to prevent theft of the clubs individually from the golf bag, and to prevent theft of the entire golf bag itself. The device generally comprises two semi-circular half-shells which are designed to fit over the top or mouth of a golf bag, and which are designed to be secured to the golf bag itself when the half shells are locked together. The half shells are hinged together at one side, and are provided with a locking mechanism at the other side. A hole is defined at the center of the shells, and will close around the shafts of a set of golf clubs, in order to hold them tightly and securely together around the generally narrower portion of the shafts. The greater dimensions of the tapered golf club handles prevent removal of any one golf club while the two shells are closed together over the top of the golf bag. A layer of resilient material is provided around the inner periphery of the center hole, in order to clamp the golf clubs firmly together, and to prevent injuring the golf clubs by contact with the cover portion of the security device. Retaining bolts or pins extend through the sides of the top of the golf club bag and are adapted to engage brackets on the inner sides of the semi-circular shells, to secure the main body of the device in place over the mouth of the golf bag when the two shells are locked together.

It is therefore an object of this invention to provide a device which can be used to prevent theft of golf clubs from a golf club bag. It is a further object of the invention to provide a device which can be used to prevent theft of a golf club bag. It is also an object of the invention to provide a security device for firmly retaining a set of golf clubs without marring the finish of the shafts of the golf clubs.

Further objects and advantages of this invention will become apparent from the drawings and description of the invention contained below.

BRIEF DESCRIPTION OF THE DRAWINGS

The following is a description of the drawings of the preferred embodiment of the present invention.

DETAILED DESCRIPTION OF THE INVENTION

Figure 1:
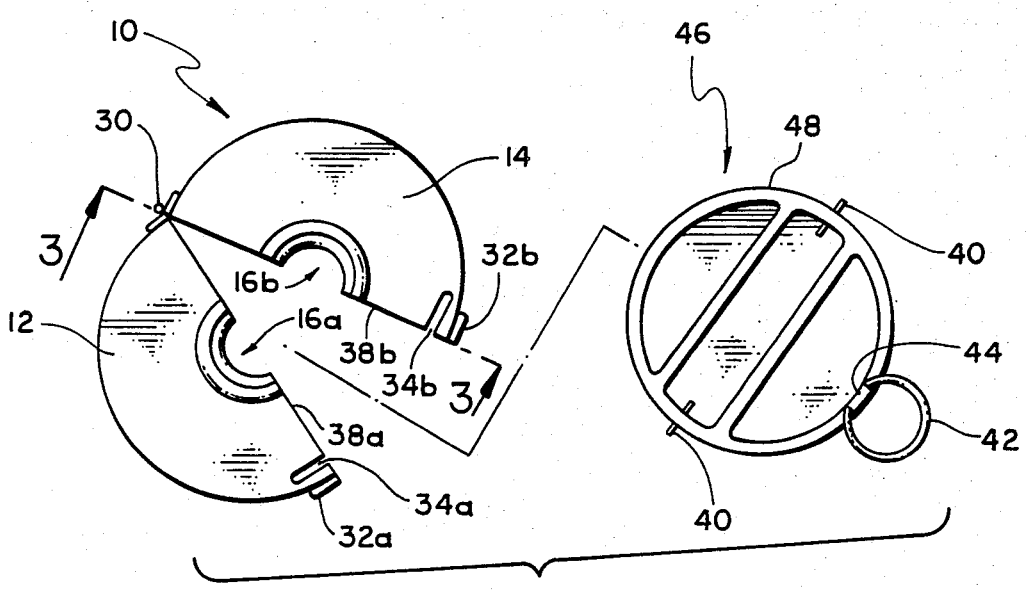
FIG. 1 is a top plan breakaway view of the main body of the security device and the mouth of a golf club bag adapted for combination with the security device of the invention.
Figure 2:
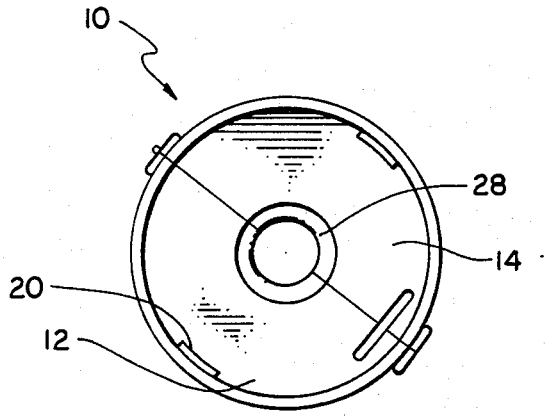
FIG. 2 is a bottom plan view of the main body of the security device.
Figure 3:
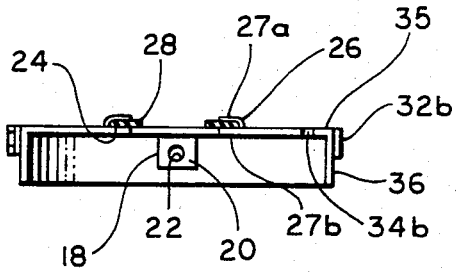
FIG. 3 is a sectional view taken along lines 3—3 of FIG. 2.

The preferred security device of the present invention is shown in combination with a golf club bag generally in FIG. 1. The security device comprises a main body portion 10, which in the preferred embodiment consists of a first generally semi-circular shaped half-shell 12 and a second generally semi-circular shaped half-shell 14 which symmetrically match to form the generally semi-circular main body when placed together. Half-shells 12 and 14 are preferably formed of a hard, lightweight material, such as a molded thermoset plastic, or aluminum metal. Fiberglass is a presently preferred material, but any such hard, lightweight material which can be formed to the shapes of the half-shells and which will resist unauthorized entry should be suitable. The half-shells 12 and 14 are hinged together at one side for pivotal movement, so that the main body may be conveniently opened and closed. Semi-circular openings in the approximate center of each shell 12 and 14 are shown generally by reference numerals 16*a* and 16*b*, and are intended for the containment of shafts of a conventional set of golf clubs. As is best shown in FIG. 3, a chamber 24 is preferably integrally formed on the upper side of each shell by a side wall 26, a top flange 27*a* and a bottom flange 27*b*. Bottom flange 27*b* is preferably contiguous and integral with the upper portion or roof 35 of the shell. Chamber 24 is adapted to contain a resilient retaining member 28. The resilient retaining member is preferably formed of an elastomeric material, and it has been found that silicon rubber is suitable for this purpose. When half shells 12 and 14 are closed together, along their mating surfaces 38*a* and 38*b*, the set of golf club shafts contained within opening 16 in the center of the main body of the security device are tightly and securely clamped by the security device, preventing removal of one or more of the golf clubs until the security device is opened.

Permanently securing the two shells 12 and 14 together is hinge mount 30, by which the two shells pivot open and closed, as described. On the side of each shell opposite to the hinge mount is located a first piece of a locking mechanism 32*a* and a second piece of the locking mechanism 32*b*, which can be operated to lock the body of the security device in a closed position. The locking mechanism may be any suitable means for locking the shells together, such as are known in the art.

Extending downward from the roof or upper portion 35 of the shell member is a lip or flange 36 of the shell member, as is best seen in FIG. 3. The lip 36 in the preferred embodiment contains one or more backets 18, having a raised portion of the bracket 20 and a socket portion 22, adapted to receive a bolt or pin 40 mounted to extend outwardly on the golf bag at the mouth 48 thereof. When each shell 12, 14 is closed around the mouth of the bag 48 and the bolts 40 are properly received in brackets 18, the body of the security device is firmly secured to the top of the golf bag. Alternativly, the lip of the shell members may include bolts or pins, designed to be received by brackets or sockets mounted on the mouth 48 of the golf bag.

As an additional feature of the security device, it is preferred that a notch is formed in each of the shells to form a chain ring opening, 34*a*, 34*b*, adapted to receive a chain ring 42, mounted at 44 on the upper portion of the mouth of the bag. At least a portion of the chain ring 42 is thereby extended through the chain ring opening 34, so that a security chain, not shown, may be locked to the chain ring and to a support or stand, or other permanent fixture, which will thereby prevent removal of the assembled combination of the security device and golf club bag.

It should be understood that this description of the preferred embodiment of the present invention is subject to numerous variations as to many of its elements, and that this description is by way of example.

For instance, as an alternative to the placement of chamber 24 on the upper surface 35 of the shell members, the chamber for the retention of the resilient retaining member could be placed on the underside of the roof 35 of the shell member, or at the same level as of the roof of the shell member.

Other members other than the bracket and bolt arrangement of the invention described could be used as well, such as an annular ring surrounding the mouth of the bag, and an annular backet arrangement adapted to receive the outwardly extended annular ring. In addition, the hinge mount 30 could be permanently mounted on the top of the mouth of the bag, as a permanent feature of the golf bag itself, so that storage and handling of the security device need not be provided for.

This invention having been described in its preferred and alternative embodiments, it is clear that is it susceptible to numerous modifications and embodiments within the ability of those skilled in the art and without the exercise of the inventive faculty. Thus, it should be understood that various changes in form, detail and application of the present invention may be made without departing from the spirit and scope of this invention.

I claim:

1. A security device adapted for combination with a golf club bag, said golf club bag having a main tubular portion and a mouth portion forming an opening in said bag for receiving golf clubs, said device comprising in combination:

(a) a main body having first and second portions hingedly connected with each other, said hinged portions comprising symmetrically matching semi-circular shell members having corresponding mating surfaces across their diametrical chords;

(b) means for releasably locking said mating surfaces of said first and second body portions in a position adjacent to each other;

(c) each of said shell members having a surface defining a central recess in said mating surface at the center of said chords, adapted to receive the shafts of said golf clubs;

(d) first and second retaining members on said first and second shell members, respectively, located adjacent to said central recesses of said shell members, for retaining said golf clubs in a central opening formed by said central recesses when said mating surfaces are locked in said position adjacent to each other; and (e) means for mounting said body to said mouth portion of said golf club bag.

2. The security device of claim 1, wherein each of said first and second retaining members of said shell members comprises a semi-circular chamber adjacent said central recess and defined by a vertical side wall, and top and bottom flanges extending radially inwardly into said recess approximately perpendicularly from said side wall, said chamber being open towards the diametrical chord of said shell member, said chamber further containing a resilient member within said chamber extending radially inwardly into said recess beyond the periphery of said chamber, for retaining said golf clubs in said central recess when said mating surfaces are locked in said position to each other.

3. The security device of claim 2, wherein said means for mounting said body to said mouth portion comprises a lip portion of each of said shell members extending downwardly approximately perpendicular to the plane of said semi-circular shell members, said lip portion adapted to fit around said mouth portion, each of said lip portions having at least one first means for interfitting with a corresponding second means for interfitting mounted on said mouth portion.

4. The security device of claim 3, wherein said first means for interfitting comprises a bracket mounted to said lip portion having a socket defined therein, and said second means for interfitting comprises a bolt mounted to and extending outwardly from said mouth portion, said socket being adapted to receive said bolt when said main body is placed over said mouth portion and said mating surfaces are locked in said position adjacent to each other, thereby securing said main body to said golf bag.

5. The security device of claim 4, wherein a chain ring is mounted to said mouth portion of said golf bag and the surface of each of said shell members further defines a chain ring recess mutually adjacent and defining an elongated chain ring opening in said main body when said mating surfaces are positioned adjacent to each other, said chain ring opening being adapted to receive said chain ring and to permit said chain ring to extend at least partially therethrough.

* * * * *